US010071472B2

(12) United States Patent
Osterhout et al.

(10) Patent No.: US 10,071,472 B2
(45) Date of Patent: Sep. 11, 2018

(54) OUTFEED TABLE

(71) Applicant: Packsize LLC, Salt Lake City, UT (US)

(72) Inventors: Ryan Osterhout, West Haven, UT (US); Niklas Pettersson, Vasteras (SE)

(73) Assignee: Packsize LLC, Salt Lake City, UT (US)

( * ) Notice: Subject to any disclaimer, the term of this patent is extended or adjusted under 35 U.S.C. 154(b) by 0 days.

(21) Appl. No.: 14/856,130

(22) Filed: Sep. 16, 2015

(65) Prior Publication Data

US 2016/0001441 A1 Jan. 7, 2016

Related U.S. Application Data

(63) Continuation-in-part of application No. 29/490,477, filed on May 9, 2014, now Pat. No. Des. 762,252.

(51) Int. Cl.

| | |
|---|---|
| ***B65H 31/34*** | (2006.01) |
| ***B25H 1/02*** | (2006.01) |
| ***B25H 1/16*** | (2006.01) |
| ***B25H 1/18*** | (2006.01) |
| ***B65H 29/26*** | (2006.01) |
| ***B26D 7/32*** | (2006.01) |

(52) U.S. Cl.

CPC ..... *B25H 1/02* (2013.01); *B25H 1/16* (2013.01); *B25H 1/18* (2013.01); *B26D 7/32* (2013.01); *B65H 29/26* (2013.01); *B65H 2404/692* (2013.01); *Y10T 83/222* (2015.04); *Y10T 83/2216* (2015.04)

(58) Field of Classification Search

USPC ..... 101/240; 108/32, 5; 193/45–47; 198/374; 211/72, 73; 271/175, 185, 207, 271/210, 279; 400/625; 414/758, 770, 414/780, 788, 788.9, 794.4; 83/157, 161, 83/165, 166

See application file for complete search history.

(56) References Cited

U.S. PATENT DOCUMENTS 460,032 A * 9/1891 Richmond ..... A47B 41/02 108/32
1,848,890 A * 3/1932 Kennedy ..... A47F 5/10 118/504

(Continued)

FOREIGN PATENT DOCUMENTS

WO WO-2013071073 A1 * 5/2013 ..... B26D 1/18

OTHER PUBLICATIONS

U.S. Appl. No. 29/490,477, filed Oct. 21, 2015, Office Action.

*Primary Examiner* — Gregory W Adams
(74) *Attorney, Agent, or Firm* — Workman Nydegger

(57) ABSTRACT

A system that converts fanfold material into packaging templates includes a converting machine and an outfeed table. The converting machine has a converting assembly that performs conversion functions, such as cutting, creasing, and scoring, on fanfold material as the fanfold material moves through the converting machine. The outfeed table guides the packaging templates out of the converting machine in a first direction. The outfeed table then directs the packaging templates to a user side of the outfeed table so that a user may readily retrieve the packaging templates from the user side of the outfeed table.

23 Claims, 12 Drawing Sheets

(56) References Cited

U.S. PATENT DOCUMENTS 1,893,460 A * 1/1933 Tilton ..... A43D 27/00 83/161
3,319,768 A * 5/1967 Holzhauer ..... B65G 47/00 177/116
3,543,926 A * 12/1970 Campbell ..... G06K 13/12 209/552
3,595,115 A * 7/1971 Pelletier ..... B23D 19/04 280/43.1
3,815,898 A * 6/1974 Haifley ..... B65C 11/02 156/499
3,946,879 A * 3/1976 Jensen ..... B65H 31/40 198/374
4,068,551 A 1/1978 Kreitz
4,106,381 A 8/1978 Kreitz
4,369,948 A * 1/1983 Krauss ..... A47B 77/10 108/32
4,406,200 A 9/1983 Kerr
4,410,023 A 10/1983 Vasquez
4,605,211 A * 8/1986 Sonobe ..... B65H 31/34 227/100
4,662,522 A * 5/1987 Kokubun ..... B07C 5/12 193/2 R
D292,154 S 10/1987 Worrell
4,759,168 A 7/1988 Petersen
4,934,423 A 6/1990 Withrow
D311,833 S 11/1990 Newhouse
5,105,698 A 4/1992 Dunham
D335,977 S 6/1993 Fleischer
5,332,210 A * 7/1994 Silverberg ..... B65H 29/68 271/220
5,379,816 A 1/1995 Charlton
D370,795 S 6/1996 Skov
5,542,232 A * 8/1996 Beierlorzer ..... B26D 5/20 53/117
D379,887 S 6/1997 Muller-Deisig
5,737,987 A * 4/1998 Olson ..... B65H 31/20 271/207
5,794,817 A * 8/1998 Rosa ..... A47F 1/08 193/47
6,397,762 B1 6/2002 Goldberg
6,668,696 B1 12/2003 Krohmer
D486,013 S 2/2004 Cesaroni
6,718,729 B2 * 4/2004 Manley ..... B31D 5/0039 493/12
6,968,763 B2 * 11/2005 Chapin ..... H05K 3/0097 53/255
D539,059 S 3/2007 Vander
7,543,614 B2 6/2009 Wise
7,665,275 B2 * 2/2010 Meessen ..... B31D 5/0043 493/464
7,975,826 B2 * 7/2011 Kato ..... B65H 29/26 193/46
8,128,335 B2 * 3/2012 Liu ..... G11B 17/04 193/46
8,327,893 B2 12/2012 Jesberger
D688,901 S 9/2013 Colson
2011/0319242 A1 * 12/2011 Pettersson ..... B65H 16/00 493/126
2013/0264771 A1 * 10/2013 Koyanagi ..... B65H 31/24 271/279

* cited by examiner

OUTFEED TABLE

CROSS-REFERENCE TO RELATED APPLICATIONS

This is a continuation-in-part of U.S. patent application Ser. No. 29/490,477, filed May 9, 2014, and entitled Outfeed Table, the entirety of which is incorporated herein by this reference.

BACKGROUND

1. Technical Field

Exemplary embodiments of the disclosure relate to systems, methods, and devices for converting sheet materials. More specifically, exemplary embodiments relate to an outfeed table used in connection with a machine that converts paperboard, corrugated board, cardboard, and similar fanfold materials into templates for boxes and other packaging.

2. Background and Relevant Art

Shipping and packaging industries frequently use paperboard and other fanfold material processing equipment that converts fanfold materials into box templates. One advantage of such equipment is that a shipper may prepare boxes of required sizes as needed in lieu of keeping a stock of standard, pre-made boxes of various sizes. Consequently, the shipper can eliminate the need to forecast its requirements for particular box sizes as well as to store pre-made boxes of standard sizes. Instead, the shipper may store one or more bales of fanfold material, which can be used to generate a variety of box sizes based on the specific box size requirements at the time of each shipment. This allows the shipper to reduce storage space normally required for periodically used shipping supplies as well as reduce the waste and costs associated with the inherently inaccurate process of forecasting box size requirements, as the items shipped and their respective dimensions vary from time to time.

In addition to reducing the inefficiencies associated with storing pre-made boxes of numerous sizes, creating custom sized boxes also reduces packaging and shipping costs. In the fulfillment industry it is estimated that shipped items are typically packaged in boxes that are about 40% larger than the shipped items. Boxes that are too large for a particular item are more expensive than a box that is custom sized for the item due to the cost of the excess material used to make the larger box. When an item is packaged in an oversized box, filling material (e.g., Styrofoam, foam peanuts, paper, air pillows, etc.) is often placed in the box to prevent the item from moving inside the box and to prevent the box from caving in when pressure is applied (e.g., when boxes are taped closed or stacked). These filling materials further increase the cost associated with packing an item in an oversized box.

Custom-sized boxes also reduce the shipping costs associated with shipping items compared to shipping the items in standard-sized boxes. A shipping vehicle filled with boxes that are 40% larger than the packaged items is much less cost efficient to operate than a shipping vehicle filled with boxes that are custom-sized to fit the packaged items. In other words, a shipping vehicle filled with custom-sized packages can carry a significantly larger number of packages, which can reduce the number of shipping vehicles required to ship that same number of items. Accordingly, in addition or as an alternative to calculating shipping prices based on the weight of a package, shipping prices are often affected by the size of the shipped package. Thus, reducing the size of an item's package can reduce the price of shipping the item.

BRIEF SUMMARY

This disclosure relates to systems, methods, and devices for processing paperboard (such as corrugated cardboard) and similar fanfold materials and converting the same into packaging templates. More specifically, this disclosure relates to outfeed tables used in connection with a machine that converts fanfold materials into packaging templates for boxes and other packaging.

In one embodiment, for instance, an outfeed table includes a frame, an outfeed guide, and a retrieval guide. The outfeed guide may be connected to the frame and can be configured to guide a packaging template out of a converting machine. The packaging template may be formed from fanfold material from a fanfold bale. The outfeed guide may be configured to be horizontally offset from a center a gravity of the packaging template such that the outfeed guide is not positioned under the center of gravity of the packaging template. The retrieval guide may also be connected to the frame. The retrieval guide may have a first side and a second side. The second side may be positioned adjacent to the outfeed guide and the first side may be positioned away from the outfeed guide. The retrieval guide may include an angled surface such that the first side is vertically lower than the second side to enable a packaging template to slide across the angled surfacing towards the first side, where the packaging template can be retrieved.

In another embodiment, an outfeed table may include a frame, a first outfeed guide, a second outfeed guide, and a retrieval guide. The first outfeed guide may be connected to the frame and be configured to guide a first packaging template out of a converting machine. The packaging template may be formed from fanfold material from a first fanfold bale and the first outfeed guide may be configured to be horizontally offset from a center a gravity of the first packaging template such that the first outfeed guide is not positioned under the center of gravity of the first packaging template.

Similar to the first outfeed guide, the second outfeed guide may be connected to the frame and be configured to guide a second packaging template out of a converting machine. The second packaging template may be formed from fanfold material from a second fanfold bale and the second outfeed guide may be configured to be horizontally offset from a center a gravity of the second packaging template such that the second outfeed guide is not positioned under the center of gravity of the second packaging template. Additionally, the second outfeed guide may be horizontally offset from the first outfeed guide.

The retrieval guide may also be connected to the frame. The retrieval guide may have a first side and a second side, the second side being positioned adjacent to the first outfeed guide and the first side being positioned away from the first outfeed guide. The retrieval guide may also include an angled surface such that the first side is vertically lower than the second side to enable the first packaging template to slide across the angled surfacing towards the first side, where the first packaging template can be retrieved.

In yet another embodiment, an outfeed table includes a first outfeed guide, a second outfeed guide, a first retrieval guide, and a second retrieval guide. The first outfeed guide may be configured to guide a first packaging template out of a converting machine while the first outfeed guide is horizontally offset from a center a gravity of the first packaging template such that the first outfeed guide is not positioned under the center of gravity of the first packaging template. The second outfeed guide may be configured to guide a second packaging template out of the converting machine while the second outfeed guide is horizontally offset from a center a gravity of the second packaging template such that the second outfeed guide is not positioned under the center of gravity of the second packaging template. The second outfeed guide may be horizontally offset from the first outfeed guide.

The first retrieval guide may be associated with the first outfeed guide and include a first side and a second side. The second side may be positioned adjacent to the first outfeed guide and the first side may be positioned away from the first outfeed guide. The first retrieval guide may include an angled surface such that the first side is vertically lower than the second side to enable the first packaging template to slide across the angled surfacing towards the first side, where the first packaging template can be retrieved. Similarly, the second retrieval guide may be associated with the second outfeed guide and may include a first side and a second side. The second side may be positioned adjacent to the second outfeed guide and the first side may be positioned away from the second outfeed guide. The second retrieval guide may also include an angled surface such that the first side is vertically lower than the second side to enable the second packaging template to slide across the angled surfacing towards the first side, where the second packaging template can be retrieved.

In still yet another embodiment, a method for guiding packaging templates out of a converting machine may include guiding a packaging template out of a converting machine in a first direction by supporting the packaging template from underneath at a location away from a center of gravity of the packaging template. The method may also include changing the direction of movement of the packaging template from the first direction to a second direction by allowing the packaging template to slide down an inclined surface.

Additional features and advantages of exemplary implementations of the disclosure will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. For better understanding, the like elements have been designated by like reference numbers throughout the various accompanying figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

The embodiments described herein generally relate to systems, methods, and devices for processing paperboard and similar fanfold materials and converting the same into packaging templates. More specifically, the described embodiments relate to an outfeed table for use in connection with a machine that converts raw material into packaging templates, and related methods. Such outfeed table can assist with properly outfeeding the packaging templates from the converting machine and positioning the packaging templates at one or more desirable locations for retrieval by a user.

While the present disclosure will be described in detail with reference to specific configurations, the descriptions are illustrative and are not to be construed as limiting the scope of the claimed invention. Various modifications can be made to the illustrated configurations without departing from the spirit and scope of the invention as defined by the claims. For better understanding, like components have been designated by like reference numbers throughout the various accompanying figures.

As used herein, the term "bale" refers to a stock of sheet material that is generally rigid and may be used to make a packaging template. For example, the bale may be formed of a continuous sheet of material or a sheet of material of any specific length, such as corrugated cardboard and paperboard sheet materials, and includes stacks of fanfold material. Additionally, the bale may have stock material that is substantially flat, folded, or wound onto a bobbin.

As used herein, the term "packaging template" refers to a substantially flat stock of material that can be folded into a box-like shape. A packaging template may have notches, cutouts, divides, and/or creases that allow the packaging template to be bent and/or folded into a box. Additionally, a packaging template may be made of any suitable material, generally known to those skilled in the art. For example, cardboard or corrugated paperboard may be used as the template material. A suitable material also may have any thickness and weight that would permit it to be bent and/or folded into a box-like shape.

As used herein, the term "crease" refers to a line along which the template may be folded. For example, a crease may be an indentation in the template material, which may aid in folding portions of the template separated by the crease, with respect to one another. A suitable indentation may be created by applying sufficient pressure to reduce the thickness of the material in the desired location and/or by removing some of the material along the desired location, such as by scoring.

The terms "notch," "cutout," and "cut" are used interchangeably herein and shall refer to a shape created by removing material from the template or by separating portions of the template, such that a cut through the template is created.

Figure 1:
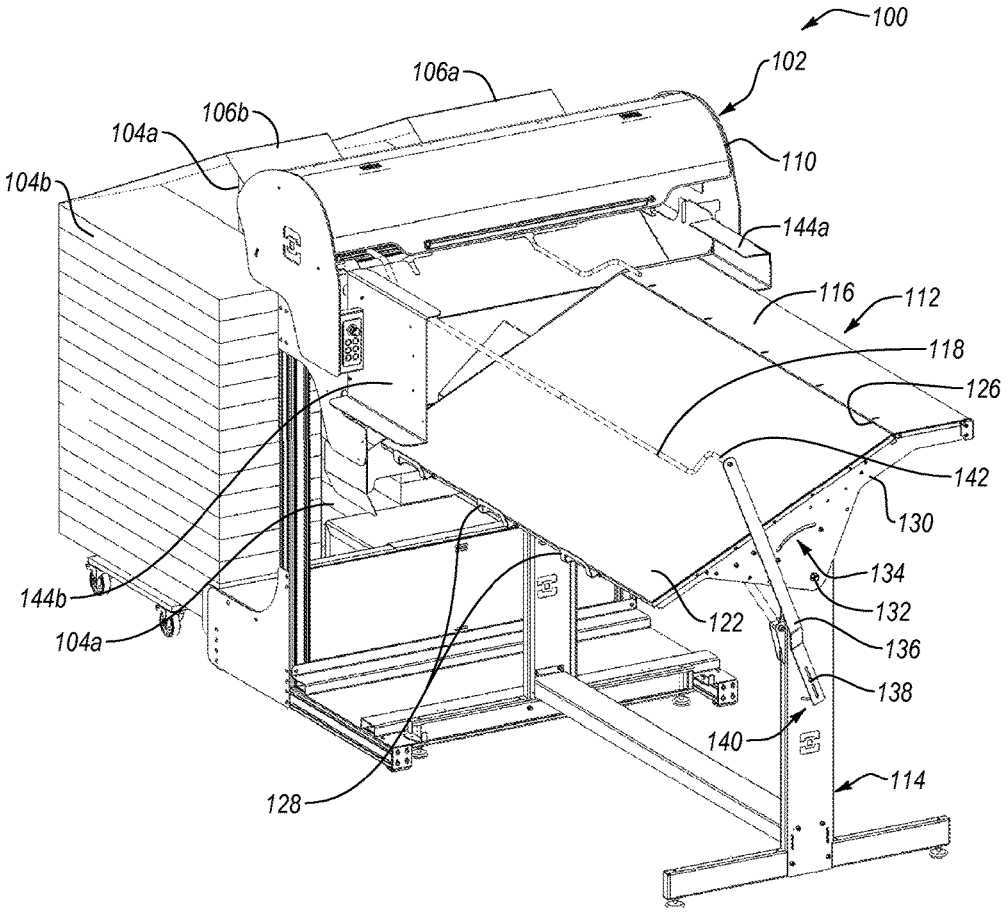
FIG. 1 illustrates a perspective view of a system for forming packaging templates as described in one aspect of this disclosure.
Figure 2:
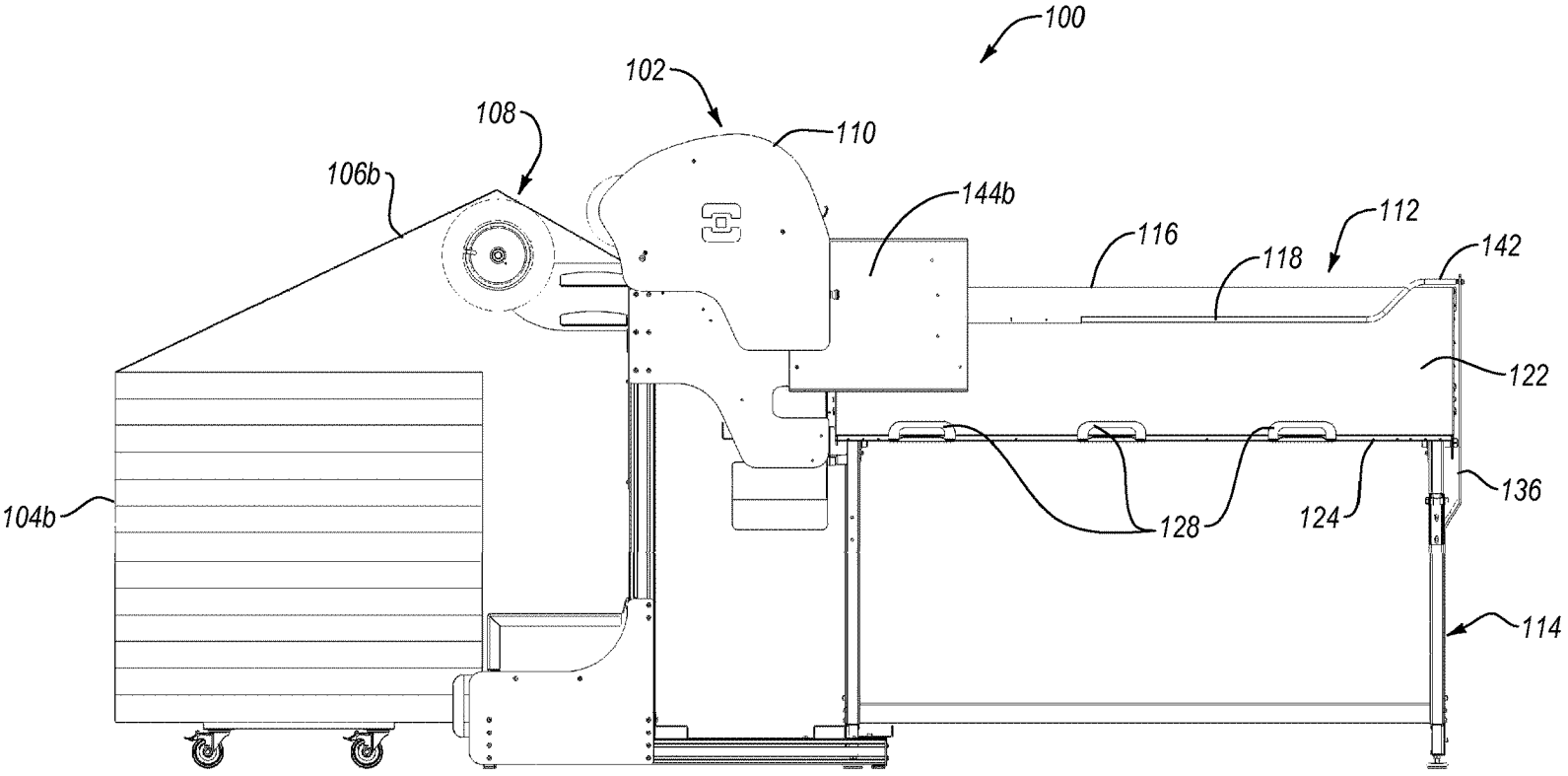
FIG. 2 illustrates a side view of the system of FIG. 1.

As illustrated in FIGS. 1 and 2, a system 100 for forming packaging templates can include a converting machine 102 and one or more fanfold bales 104 (e.g., bales 104*a*, 104*b*). Generally, the converting machine 102 can receive fanfold material 106 (e.g., fanfold material 106*a*, 106*b*) from the one or more fanfold bales 104 to produce packaging templates. The packaging templates can be used to form boxes or other packaging. Because the packaging templates can be produced on demand and can have custom sizes, a shipper can produce boxes just in time for shipping, thereby avoiding the need to store standard-sized box templates.

The one or more fanfold bales 104 may be disposed proximate to a bale side of the converting machine 102, and the fanfold material 106 may be fed into the bale side of the converting machine 102 as shown in FIGS. 1 and 2, for example. The fanfold material 106 may be arranged in the one or more fanfold bales 104 as multiple stacked layers. The layers of the fanfold material 106 in each fanfold bale 104 may have generally equal lengths and widths and may be folded one on top of the other in alternating directions.

As shown in FIGS. 1 and 2, the converting machine 102 can include an infeed system 108 and a converting assembly 110. The infeed system 108 can feed the fanfold material 106 into the converting assembly 110. As the fanfold material 106 moves through the converting assembly 110, the converting assembly 110 can perform various conversion functions on the fanfold material 106 in order to create a package template out of the fanfold material 106.

The infeed system 108 and/or the converting assembly 110 may include one or more feed rollers that may pull the fanfold material 106 into the converting assembly 110 and/or advance the fanfold material 106 therethrough. The feed rollers may be configured to pull the fanfold material 106 with limited or no slip and may be smooth, textured, dimpled, and/or teethed.

The conversion functions performed by the converting assembly 110 to create the packaging templates may include one or more of creasing, bending, folding, perforating, cutting, and/or scoring. The creases, bends, folds, perforations, cuts, and/or scores may be made on the fanfold material 106 in a direction substantially parallel to the direction of movement and/or length of the fanfold material 106. The creases, bends, folds, perforations, cuts, and/or scores also may be made on the fanfold material 106 in a direction substantially perpendicular to the direction of movement and/or length of the fanfold material 106.

Accordingly, the converting assembly 110 may comprise a conversion mechanism that is configured to crease, bend, fold, perforate, cut, and/or score the fanfold material 106 in order to create the packaging templates. The conversion mechanism may include various tools (e.g., creasing wheels, cutting wheels, knives, etc.) for making the creases, bends, folds, perforations, cuts, and/or scores in the fanfold material 106.

One or more of the tools, such as cutting and creasing wheels, may move within the converting assembly 110 in a direction generally perpendicular to the direction in which the fanfold material 106 is fed through the converting assembly 110 and/or the length of the fanfold material 106. For instance, the converting assembly 110 may have one or more longitudinal converting tools that may perform one or more of above-described conversion functions on the fanfold material 106 in a longitudinal direction (e.g., in the direction of the movement of the fanfold material 106 and/or parallel to the length of the fanfold material 106) as the fanfold material 106 advances through the converting assembly 110.

The converting assembly 110 may move the one or more longitudinal converting tools back and forth in a direction that is perpendicular to the length of the fanfold material 106 in order to properly position the one or more longitudinal converting tools relative to the sides of the fanfold material 106. By way of example, if a longitudinal crease or cut needs to be made two inches from one edge of the fanfold material 106 (e.g., to trim excess material off of the edge of the fanfold material 106), the converting assembly 110 may move one of the longitudinal converting tools perpendicularly across the fanfold material 106 to properly position the longitudinal converting tool so as to be able to make the cut or crease at the desired location. In other words, the longitudinal converting tools may be moved transversely across the fanfold material 106 to position the longitudinal converting tools at the proper location to make the longitudinal conversions on the fanfold material 106.

The converting assembly 110 may also have one or more transverse converting tools, which may perform one or more of the above-described conversion functions on the fanfold material 106 in a transverse direction (e.g., in a direction substantially perpendicular to the longitudinal direction). More specifically, the converting assembly 110 may move the one or more transverse converting tools back and forth in a direction that is perpendicular to the length of the fanfold material 106 in order to create transverse (e.g., perpendicularly oriented) creases, bends, folds, perforations, cuts, and/or scores in the fanfold material 106. In other words, the transverse converting tools may be moved transversely across the fanfold material 106 in order to or while making the transverse conversions on the fanfold material 106.

After the conversion functions have been performed on the fanfold material 106, or a portion thereof, the resulting packaging template can exit the converting assembly 110 on an outfeed side of the converting machine 102. It should be noted that the term "packaging template" refers to any portion of a packaging template, whether completed or unfinished. Accordingly, the term "packaging template" includes any portion of the fanfold material 106 that exits the converting assembly 110.

As illustrated in FIGS. 1 and 2, an outfeed table 112 may be positioned adjacent to the outfeed side of the converting machine 102. The outfeed table 112 may guide the packaging templates as the packaging templates exit the converting assembly 110. Additionally, the outfeed table 112 may direct the packaging templates to a retrieval position adjacent one side of the outfeed table 112 to allow for ready retrieval by a user.

In the embodiment illustrated in FIGS. 1 and 2, the outfeed table 112 includes a frame 114 that can rest upon a support surface (e.g., floor) and support other portions of the outfeed table 112. The outfeed table 112 also includes a first outfeed guide 116 and a second outfeed guide 118 that are supported by the frame 114. In the illustrated embodiment, the first outfeed guide 116 comprises an elongated, generally planar surface and the second outfeed guide 118 is formed of an elongated tubular member. It will be appreciated, however, that the specific configurations, including shapes, of the first and second outfeed guides 116, 118 may vary from one embodiment to another. For instance, the first outfeed guide 116 may be formed of an elongated tubular member, while the second outfeed guide 118 comprises an elongated planar surface. It will be appreciated that an outfeed table may include a single outfeed guide to accommodate a single track of fanfold material or more than two outfeed guides to accommodate more than two tracks of fanfold material.

As can be seen in FIG. 1, the first outfeed guide 116 and the second outfeed guide 118 are horizontally offset from one another. In some embodiments, the first outfeed guide 116 and the second outfeed guide 118 can be vertically offset from one another. For instance, FIG. 2 illustrates a portion of the second outfeed guide 118 positioned vertically lower than the first outfeed guide 116.

Figure 3:
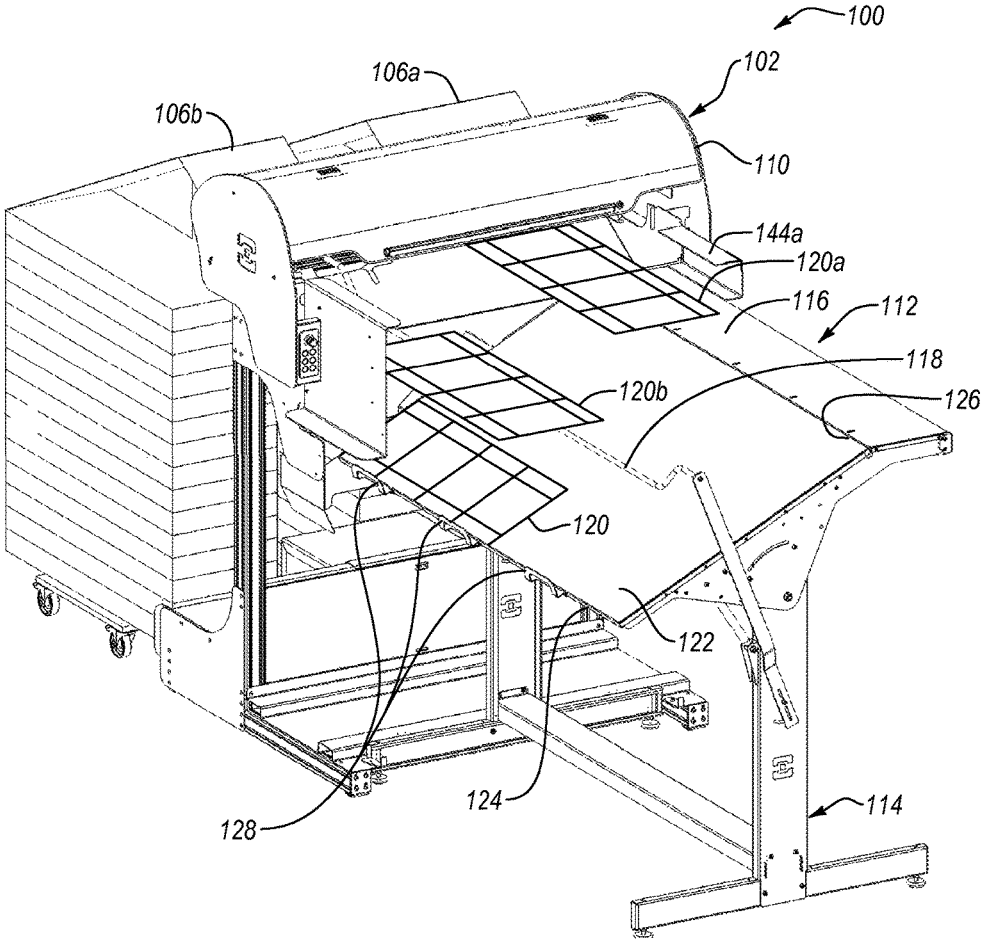
FIG. 3 illustrates a perspective view of the system of FIG. 1 showing packaging templates being fed out of a converting machine and onto an outfeed table.

The first outfeed guide 116 is configured to guide out of the converting machine 102 packaging templates that are formed from the fanfold material 106*a* from the fanfold bale 104*a*. Similarly, the second outfeed guide 118 is configured to guide out of the converting machine 102 packaging templates that are formed from the fanfold material 106*b* from the fanfold bale 104*b*. For instance, FIG. 3 illustrates packaging templates 120 (e.g., packaging templates 120*a*, 120*b*) being guided out of the converting machine 102 by the first outfeed guide 116 and the second outfeed guide 118. More specifically, FIG. 3 illustrates a packaging template 120*a* being guided out of the converting machine 102 by the first outfeed guide 116 and a packaging template 120*b* being guided out of the converting machine 102 by the second outfeed guide 118.

As can be seen in FIG. 3, the first outfeed guide 116 is generally aligned with the fanfold material 106*a* such that at least a portion of the packaging template 120*a* is positioned above the first outfeed guide 116 as the packaging template 120*a* extends out of the converting machine 102. Likewise, the second outfeed guide 118 is generally aligned with the fanfold material 106*b* such that at least a portion of the packaging template 120*b* is positioned above the second outfeed guide 118 as the packaging template 120*b* extends out of the converting machine 102. Notably, however, and as will be discussed in greater detail below, the center of gravity of the packaging templates 120*a*, 120*b* are not positioned above the first and second outfeed guides 116, 118, respectively. As a result, once the packaging templates 120 are completed and the converting machine 102 releases them, the packaging templates 120 can descend onto a retrieval guide 122.

In the illustrated embodiment, the retrieval guide 122 comprises a generally planar surface on which the packaging templates 120 can slide and/or rest. The generally planar surface of the retrieval guide 122 is oriented at an angle such that a first, user, or retrieval side 124 thereof is positioned vertically lower than an opposing second side 126. The angled orientation of the retrieval guide 122 allows packaging templates 120 to slide down/across the surface thereof toward the first side 124. For instance, FIG. 3 illustrates a packaging template 120 that has descended (from one of the first and second outfeed guides 116, 118) onto the retrieval guide 122 and slid down the angled surface toward the first side 124 (as indicated by the illustrated arrow).

One or more stops 128 may be disposed at the first side 124 and may extend generally upwardly from the first side 124. The one or more stops 128 may be configured to prevent the packaging templates 120 from sliding off of the first side 124 and/or hold the packaging templates 120 on the retrieval guide 122 until a user retrieves/removes the packaging templates 120 therefrom.

In some embodiments, the second side 126 of the retrieval guide 122 may be positioned adjacent to and/or connected to the first outfeed guide 116. In other embodiments, however, the second side 126 may be used as the first outfeed guide 116. In such embodiments, the first outfeed guide 116 may comprise the edge of the second side 126 such that the first outfeed guide 116 does not comprise a generally planar surface as illustrated.

Figure 4:
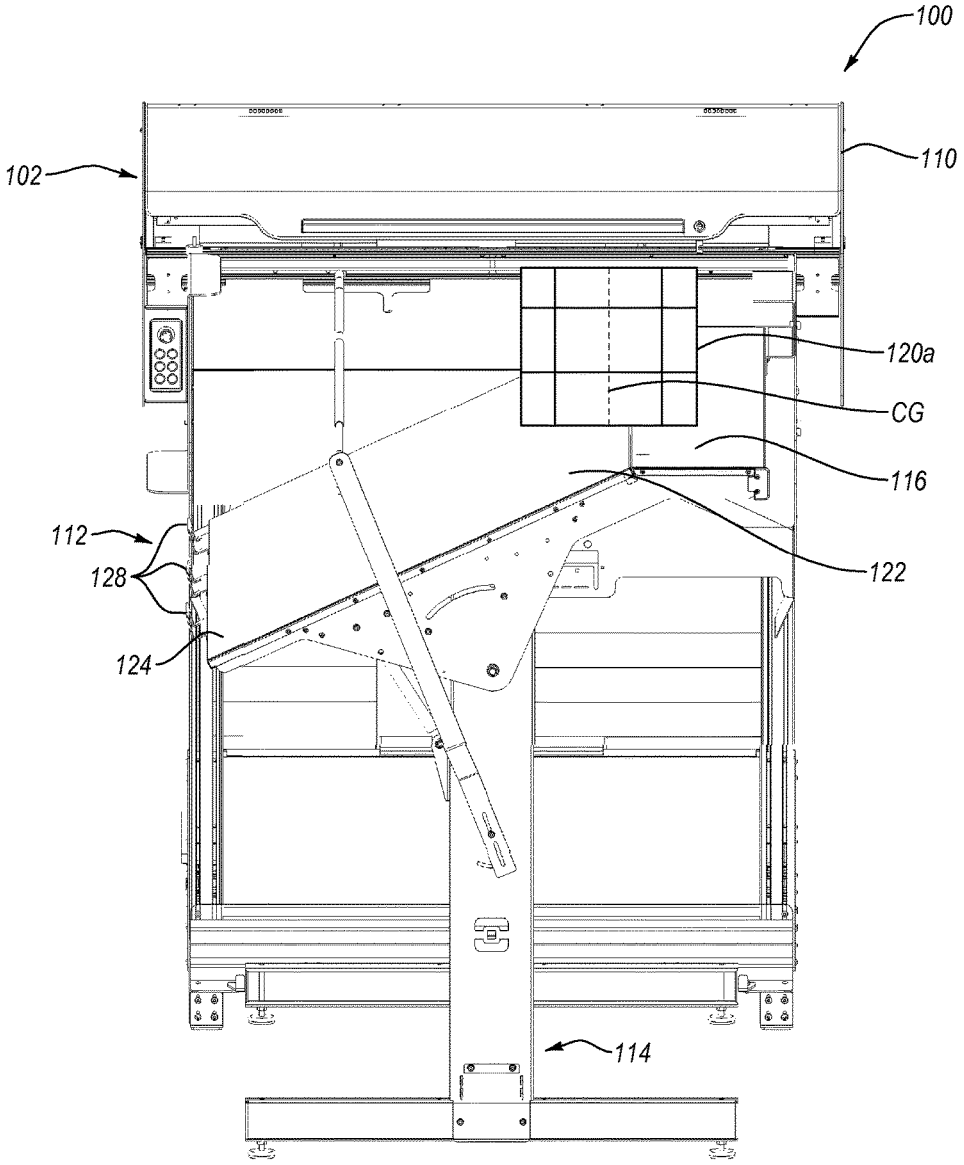
FIG. 4 illustrates an end perspective view of the system of FIG. 1 showing a packaging template being fed out of a converting machine and onto an outfeed guide of an outfeed table.
Figure 5:
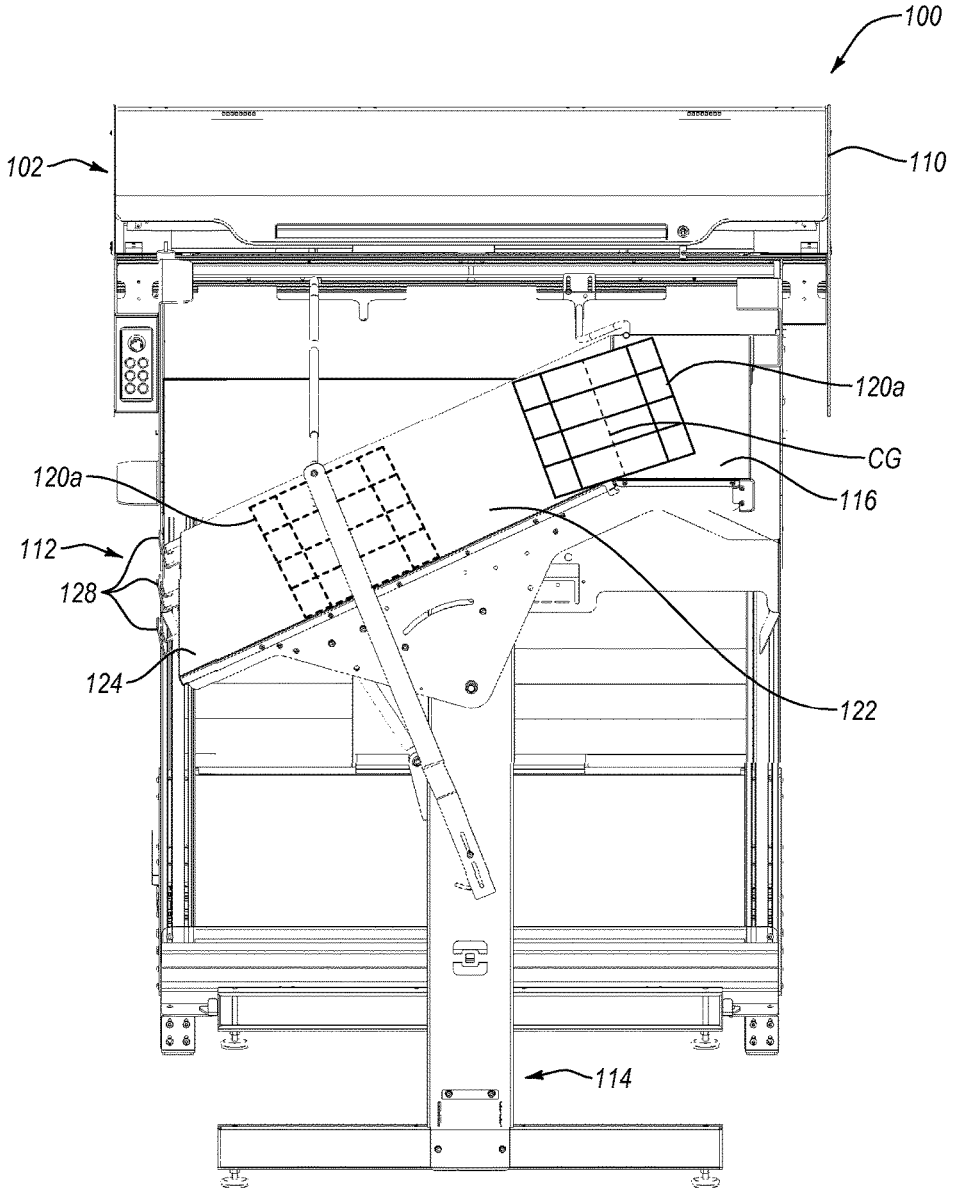
FIG. 5 illustrates an end perspective view of the system of FIG. 1 showing a packaging template moving from an outfeed guide toward a first side of an outfeed table on a retrieval guide.
Figure 6:
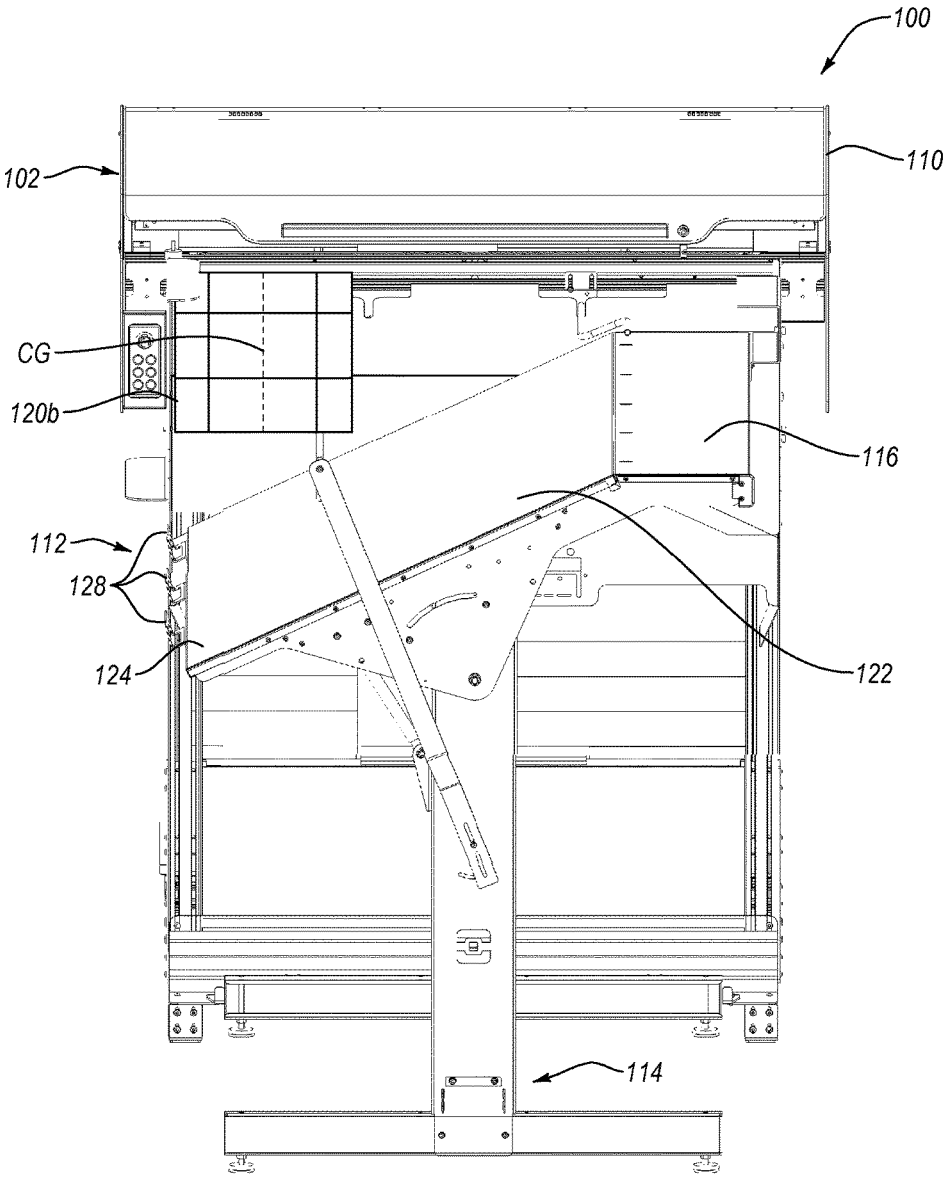
FIG. 6 illustrates an end perspective view of the system of FIG. 1 showing a packaging template being fed out of a converting machine and onto a second outfeed guide of an outfeed table.
Figure 7:
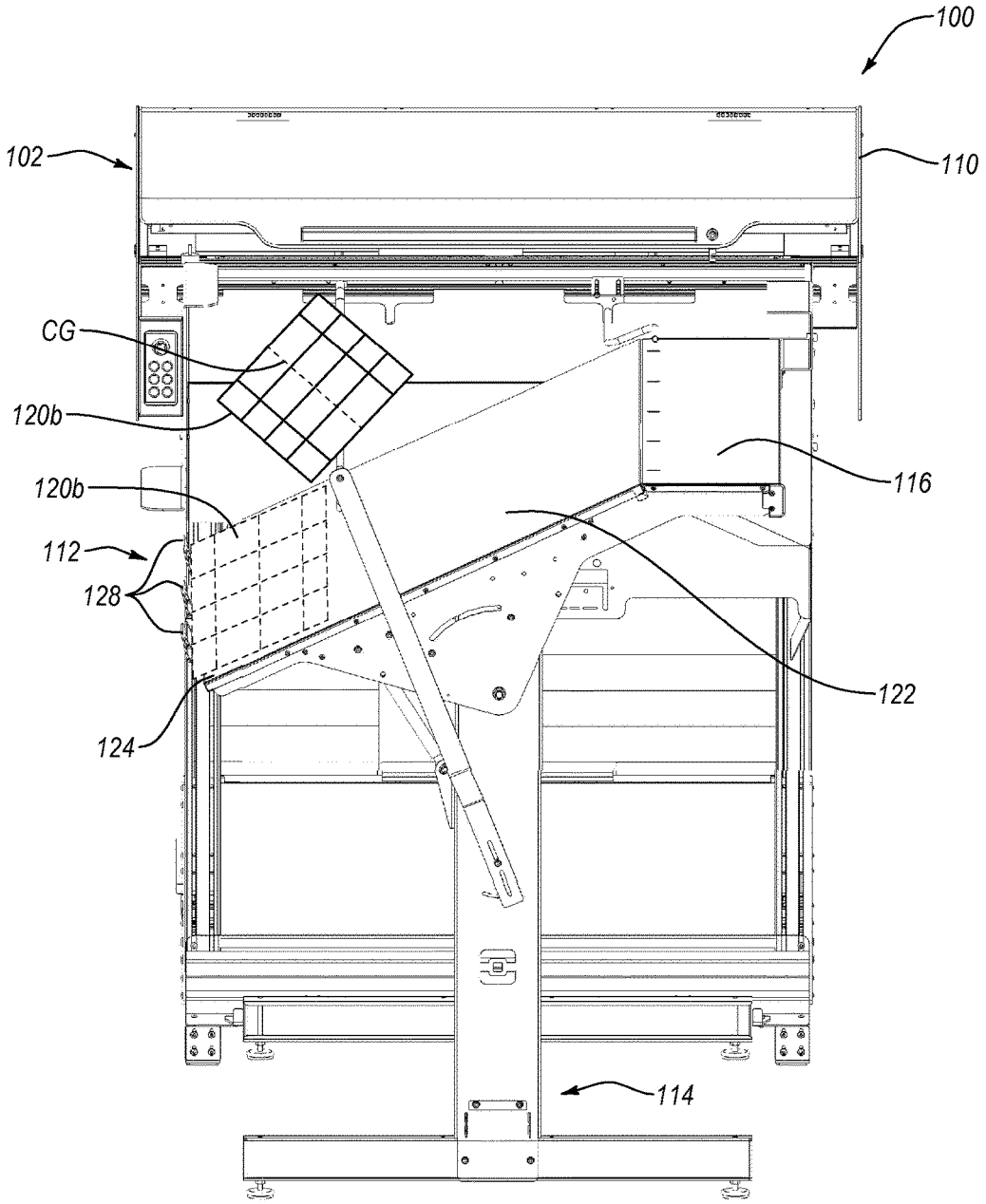
FIG. 7 illustrates an end perspective view of the system of FIG. 1 showing a packaging template moving from a second outfeed guide toward a first side of an outfeed table on a retrieval guide.

FIGS. 4-7 illustrate examples of the system 100, and particularly the outfeed table 112, in use. More specifically, FIGS. 4 and 5 illustrate a packaging template 120*a* being guided out of the converting machine 102 by the first outfeed guide 116 and to the retrieval side 124 of the outfeed table 112. Similarly, FIGS. 6 and 7 illustrate a packaging template 120*b* being guided out of the converting machine 102 by the second outfeed guide 118 and to the retrieval side 124 of the outfeed table 112.

FIG. 4 illustrates a packaging template 120*a* being guided out of the converting machine 102 by the first outfeed guide 116. More specifically, a portion of the packaging template 120*a* rests on and slides over the first outfeed guide 116 as the packaging template 120*a* exits the converting machine 102. In the illustrated embodiment, the first outfeed guide 116 extends in a generally horizontal direction such that the packaging template 120*a* is maintained in a generally horizontal orientation as the packaging template 120*a* exits the converting machine 102.

As can be seen in FIG. 4, the center of gravity CG (illustrated with a dashed line) of the packaging template 120*a* is not positioned directly above or supported from underneath by the first outfeed guide 116. As a result, once the converting machine 102 completes and releases the packaging template 120*a*, the gravitational force acting on the packaging template 120*a* will cause the packaging template 120*a* to rotate and descend onto the retrieval guide 122, as illustrated in FIG. 5. The packaging template 120*a* will then slide down the retrieval guide 122 toward the first side 124 thereof, as shown in dashed lines in FIG. 5. As noted above in connection with FIG. 3, the one or more stops 128 may prevent the packaging template 120*a* from sliding off of the first side 124 and/or hold the packaging template 120*a* on the retrieval guide 122 until a user retrieves/removes the packaging template 120*a* therefrom.

FIG. 6 illustrates a packaging template 120*b* being guided out of the converting machine 102 by the second outfeed guide 118. More specifically, a portion of the packaging template 120*b* rests on and slides over the second outfeed guide 118 as the packaging template 120*b* exits the converting machine 102. In the illustrated embodiment, the second outfeed guide 118 extends in a generally horizontal direction such that the packaging template 120*b* is maintained in a generally horizontal orientation as the packaging template 120*b* exits the converting machine 102.

As can be seen in FIG. 6, the center of gravity CG (illustrated with a dashed line) of the packaging template 120*b* is not positioned directly above or supported from underneath by the second outfeed guide 118. As a result, once the converting machine 102 completes and releases the packaging template 120*b*, the gravitational force acting on the packaging template 120*b* will cause the packaging template 120*b* to rotate and descend onto the retrieval guide 122, as illustrated in FIG. 7. The packaging template 120*b* will then slide down the retrieval guide 122 toward the first side 124 thereof, as shown in dashed lines in FIG. 7. Again, the one or more stops 128 may prevent the packaging template 120*b* from sliding off of the first side 124 and/or hold the packaging template 120*b* on the retrieval guide 122 until a user retrieves/removes the packaging template 120*b* therefrom.

One or more aspects of the outfeed table 112 may be selectively adjustable. For instance, the first outfeed guide 116 may be movably connected to the frame 114 such that the horizontal and/or vertical position of the first outfeed guide 116 is adjustable. Such adjustment of the position of the first outfeed guide 116 may be desirable if the fanfold material 106*a* is replaced with a fanfold material 106 that is narrower or wider than the fanfold material 106*a*. Thus, the horizontal position of the first outfeed guide 116 may be selectively adjusted so that the first outfeed guide 116 is positioned under a portion of any packaging template, regardless of width of the packaging template, while still allowing the center of gravity of the packaging template to be unsupported by the first outfeed guide 116.

As illustrated in FIG. 1, the first outfeed guide 116 is connected to the frame 114 via a pivot frame 130. The pivot frame 130 may be pivotally or rotatably connected to the frame 114 such that the pivot frame 130 may pivot or rotate about a pivot pin 132. Rotation of the pivot frame 130 may adjust the horizontal and/or vertical position of the first outfeed guide 116. For instance, rotation of the pivot frame 130 in a first direction may move the first outfeed guide 116 further away from a center of the converting machine 102. In contrast, rotation of the pivot frame 130 in a second direction may move the first outfeed guide 116 closer to the center of the converting machine 102. A limit mechanism 134 may restrict the degree to which the pivot frame 130 may pivot or rotate. The limit mechanism 134 may take a variety of forms, including the illustrated slot and pin configuration.

As with the first outfeed guide 116, the second outfeed guide 118 may be movably connected to the frame 114 such that the horizontal and/or vertical position of the second outfeed guide 118 is adjustable. Such adjustment of the position of the second outfeed guide 118 may be desirable if the fanfold material 106*b* is replaced with a fanfold material 106 that is narrower or wider than the fanfold material 106*b*. Thus, the horizontal position of the second outfeed guide 118 may be selectively adjusted so that the second outfeed guide 118 is positioned under a portion of any packaging template, regardless of width of the packaging template, while still allowing the center of gravity of the packaging template to be unsupported by the second outfeed guide 118.

As illustrated in FIG. 1, the second outfeed guide 118 is connected to the frame 114 via a pivot bar 136. The pivot bar 136 may be pivotally or rotatably connected to the frame 114 such that the pivot bar 136 may pivot or rotate about a pivot pin 138. Rotation of the pivot bar 136 may adjust the horizontal and/or vertical position of the second outfeed guide 118. For instance, rotation of the pivot bar 136 in a first direction may move the second outfeed guide 118 further away from the center of the converting machine 102. In contrast, rotation of the pivot bar 136 in a second direction may move the second outfeed guide 118 closer to the center of the converting machine 102. A limit mechanism 140 may restrict the degree to which the pivot bar 136 may pivot or rotate. The limit mechanism 140 may take a variety of forms, including the illustrated slot and pin configuration.

The pivot bar 136 may also be connected to the frame 114 at various locations along the length of the pivot bar 136 in order to adjust the horizontal and/or vertical position of the second outfeed guide 118. For instance, the pivot bar 136 may be connected to the frame 114 at a first location along the length of the pivot bar 136. To adjust the horizontal and/or vertical position of the second outfeed guide 118, the connection location along the length of the pivot bar 136 may be changed to effectively increase or decrease the length of the pivot bar 136 between the connection location and the second outfeed guide 118.

The second outfeed guide 118 may also or alternatively be movably connected to the pivot bar 136 to able selective adjustment of the horizontal and/or vertical position of the second outfeed guide 118. As can be seen in FIGS. 1 and 2, for instance, the second outfeed guide 118 may include an offset portion 142 that connects to the pivot bar 136. Rotation of the second outfeed guide 118 about the offset portion 142 may adjust the effective horizontal and/or vertical position of the second outfeed guide 118.

The adjustable nature of the first and second outfeed guides 116, 118 may allow for convenient and ready access to the area underneath the outfeed table 112. For instance, rotation of the first outfeed guide 116 about the pivot pin 132 may raise the retrieval guide 122 (which can be connected to the pivot frame 130) so as to allow additional access underneath the outfeed table 112. Furthermore, the adjustability of the second outfeed guide 118 may allow for the retrieval guide 122 to move vertically past the second outfeed guide 118. For instance, the second outfeed guide 118 may be rotated about the offset portion 142 to move the second outfeed guide 118 out of the way of the retrieval guide 122 so that the retrieval guide 122 may be rotated up past the second outfeed guide 118. Similarly, the second outfeed guide 118 and the pivot bar 136 may be rotated about the pivot pin 138 to move the second outfeed guide 118 out of the way of the retrieval guide 122 so that the retrieval guide 122 may be rotated up past the second outfeed guide 118. Such adjustability of the outfeed table 112 may allow a user to more easily access portions of the table 112 that are underneath the first outfeed guide 116 and/or the retrieval guide 122 or machines (e.g., box gluing devices, printers, etc.) or other items positioned or stored thereunder.

The system 100 may also include various safety features. For instance, the system 100 may include one or more guards 144 (e.g., guards 144*a*, 144*b*) disposed on opposing sides of the converting machine 102. The guards 144 may prevent a user from reaching into the converting assembly 110 and being injured by the moving parts therein (pressure wheels, converting tools, etc.). In the illustrated embodiment, the guard 144*a* is mounted on the outfeed table 112 adjacent to the first outfeed guide 116. The guard 144*b* is mounted on the converting machine opposite to the guard 144*a*. in the illustrated embodiment, the guard 144*b* is taller than the guard 144*a* due to the different heights of the first outfeed guide 116 and the retrieval side 124 of the retrieval guide 122. In some embodiments, the guards 144 may be formed of non-opaque material that allows a user to see therethrough into the converting assembly 110.

Attention is now directed to FIG. 8-12, which illustrate an embodiment of a system 100' for forming packaging templates 120. The system 100' can be similar or identical to system 100 is many aspects. For instance, system 100' can include a converting machine 102, one or more fanfold bales 104 (e.g., bales 104*a*, 104*b*), and an outfeed table 112'. Accordingly, the following discussion of FIGS. 8-12 will focus on the aspects of system 100' that are different from the system 100. In particular, attention will be directed to the outfeed table 112'.

Figure 8:
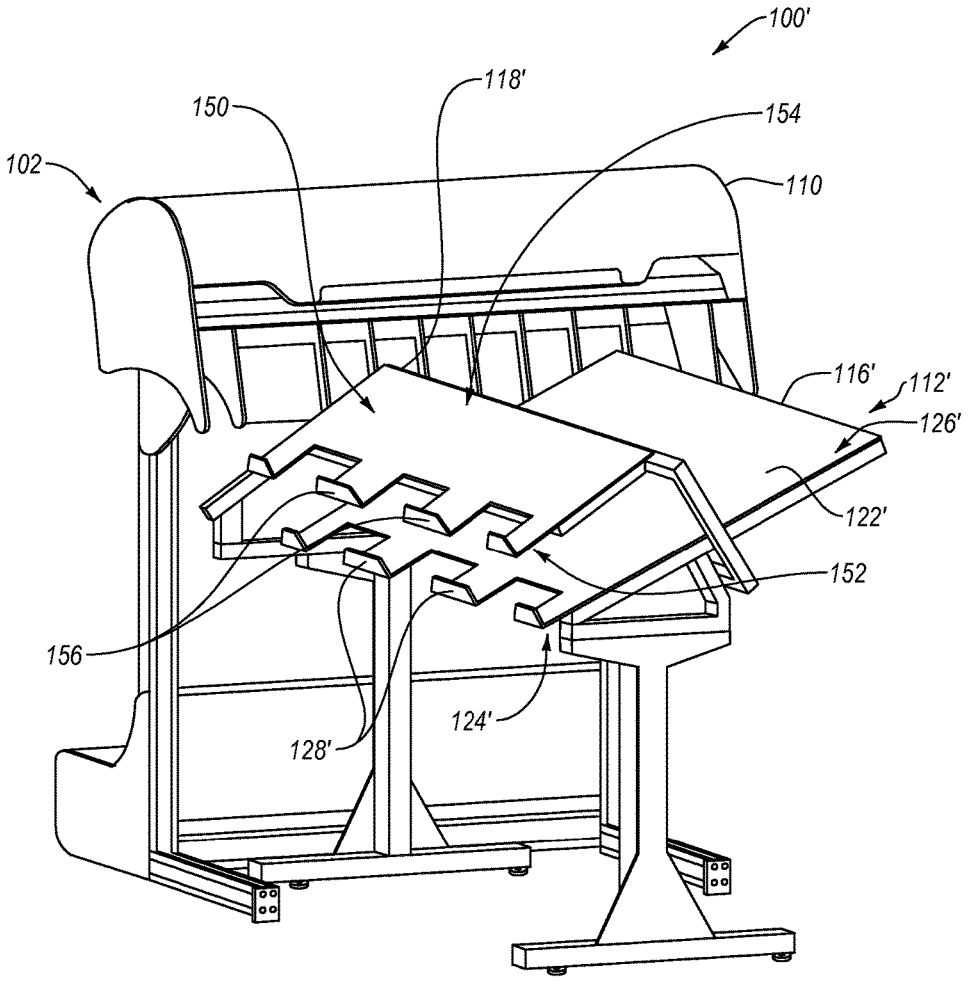
FIG. 8 illustrates a perspective view of another system for forming packaging templates as described in one aspect of this disclosure.

According to the embodiment illustrated in FIG. 8, the outfeed table 112' includes a first outfeed guide 116' and a second outfeed guide 118'. As can be seen in FIG. 8, the first outfeed guide 116' and the second outfeed guide 118' are horizontally offset from one another. Although the illustrated embodiment shows the first outfeed guide 116' and the second outfeed guide 118' being disposed at substantially the same vertical height, in some embodiments the first outfeed guide 116' and the second outfeed guide 118' can be vertically offset from one another.

In the illustrated embodiment, the first outfeed guide 116' and the second outfeed guide 118' are generally elongated, horizontally extending edges of first and second retrieval guides 122', 150, respectively. Such configuration is merely exemplary. For instance, one or both of the first and second outfeed guides 116', 118' may be configured in a manner similar to the first and second outfeed guides 116, 118. Thus, for example, one or both of the first and second outfeed guides 116', 118' may include a generally planar surface or be formed with an elongated tubular member.

Unlike the embodiment illustrated in FIGS. 1-7 (which included a single retrieval guide 122), the outfeed table 112' illustrated in FIGS. 8-12 includes first and second retrieval guides 122', 150. The first retrieval guide 122' is associated with the first outfeed guide 116' and can be substantially similar to the first retrieval guide 122 discussed above. For instance, the first retrieval guide 122' can include a first or retrieval side 124' and an opposing second side 126'. The second side 126' is positioned vertically higher than the first side 124' to enable packaging templates 120 to slide down the first retrieval guide 122' towards the first side 124'. In the illustrated embodiment, the edge of the second side 126' forms or acts as the first outfeed guide 116'. Additionally, one or more stops 128' can be associated with the first side 124' to hold packaging templates 120 on and/or prevent packaging templates 120 from sliding off of the first retrieval guide 122'.

The second retrieval guide 150 is associated with the second outfeed guide 118' and can be similar to the other retrieval guides discussed herein. For instance, the second retrieval guide 150 can include a first or retrieval side 152 and an opposing second side 154. The second side 154 is positioned vertically higher than the first side 152 to enable packaging templates 120 to slide down the retrieval guide 150 towards the first side 152. In the illustrated embodiment, the edge of the second side 154 forms or acts as the second outfeed guide 118'. Additionally, one or more stops 156 can be associated with the first side 152 to hold packaging templates 120 on and/or prevent packaging templates 120 from sliding off of the second retrieval guide 150.

As can be seen in FIG. 8, the first and second retrieval guides 122', 150 are horizontally offset from one another. Additionally, the second retrieval guide 150 is also vertically offset from or positioned above at least a portion of the first retrieval guide 122'. For instance, the first side 152 of the second retrieval guide 150 is positioned above the first side 124' of the first retrieval guide 122'. Because the second sides 126', 154 are horizontally offset from one another and generally vertically aligned with one another, the second side 154 is positioned above a central portion of the first retrieval guide 122'. As a result, the distance between the first and second sides 152, 154 of the second retrieval guide 150 is shorter than the distance between the first and second sides 124', 126' of the first retrieval guide 122'.

Figure 9:
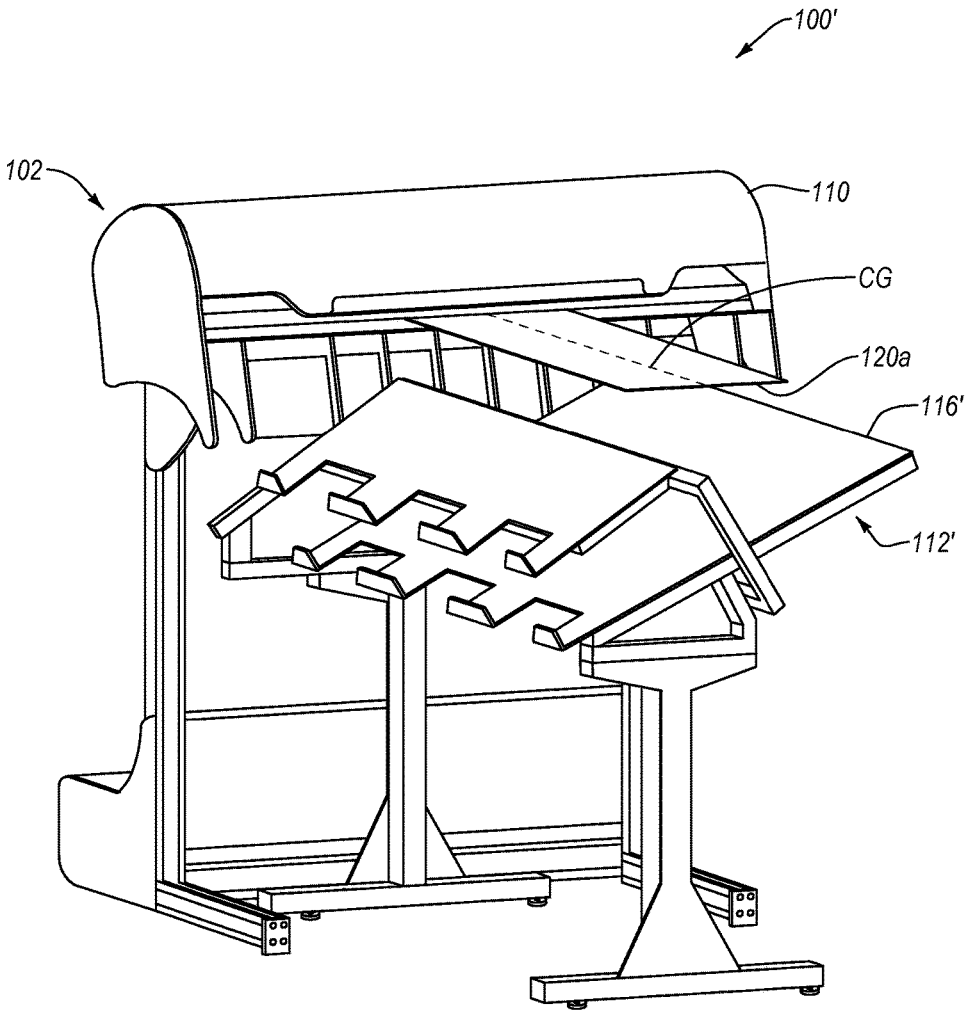
FIG. 9 illustrates a perspective view of the system of FIG. 8 showing a packaging template being fed out of a converting machine and onto an outfeed guide of an outfeed table.
Figure 10:
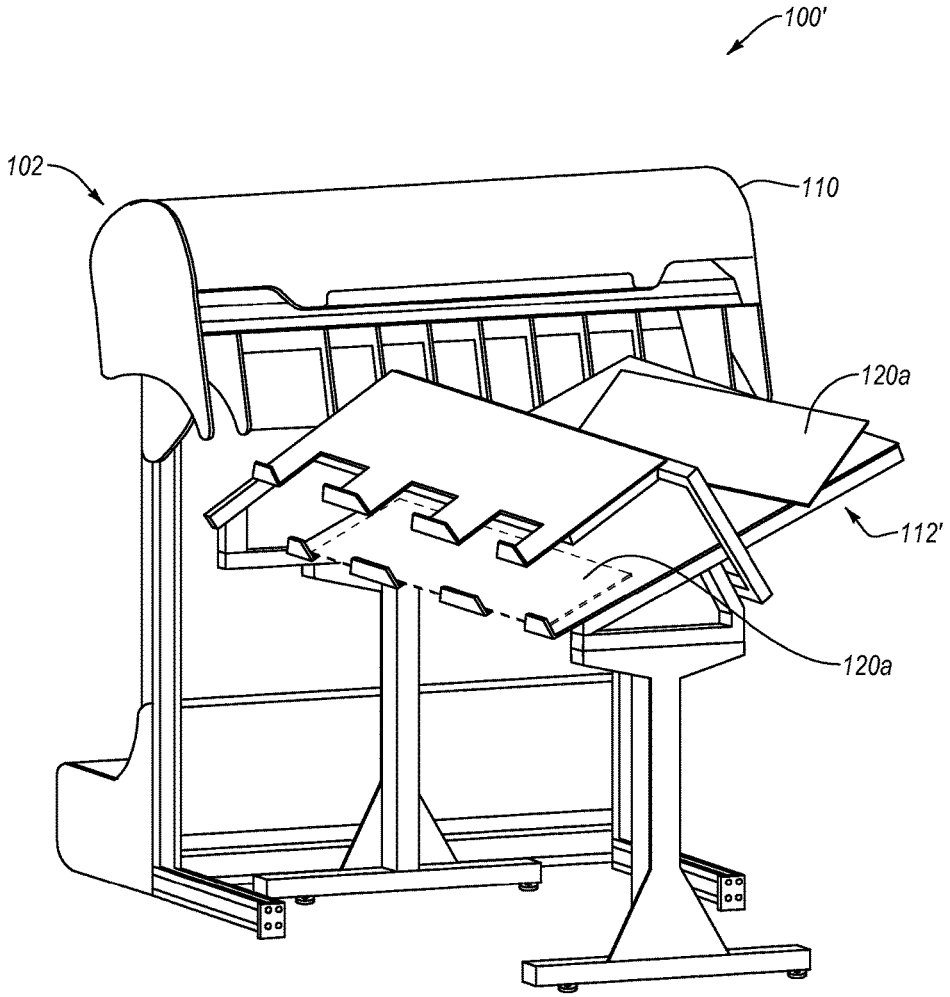
FIG. 10 illustrates an end perspective view of the system of FIG. 8 showing a packaging template moving from an outfeed guide toward a first side of an outfeed table on a retrieval guide.
Figure 11:
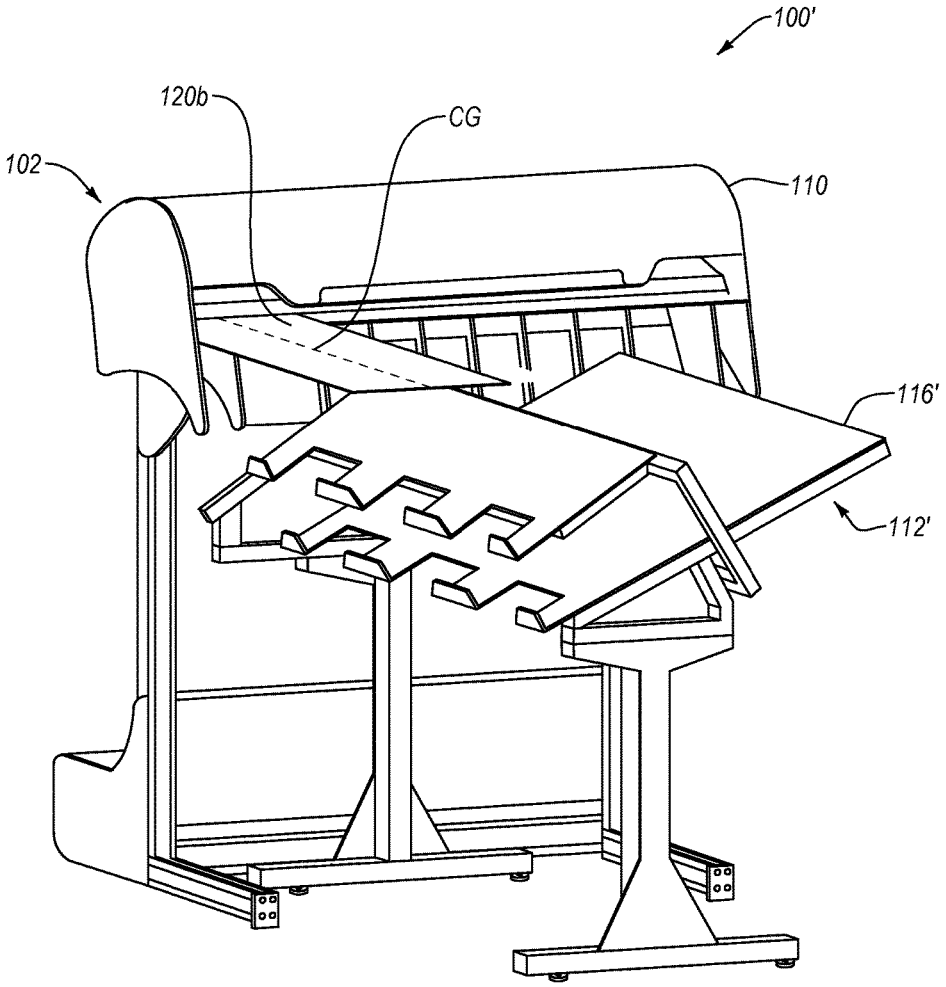
FIG. 11 illustrates a perspective view of the system of FIG. 8 showing a packaging template being fed out of a converting machine and onto a second outfeed guide of an outfeed table.
Figure 12:
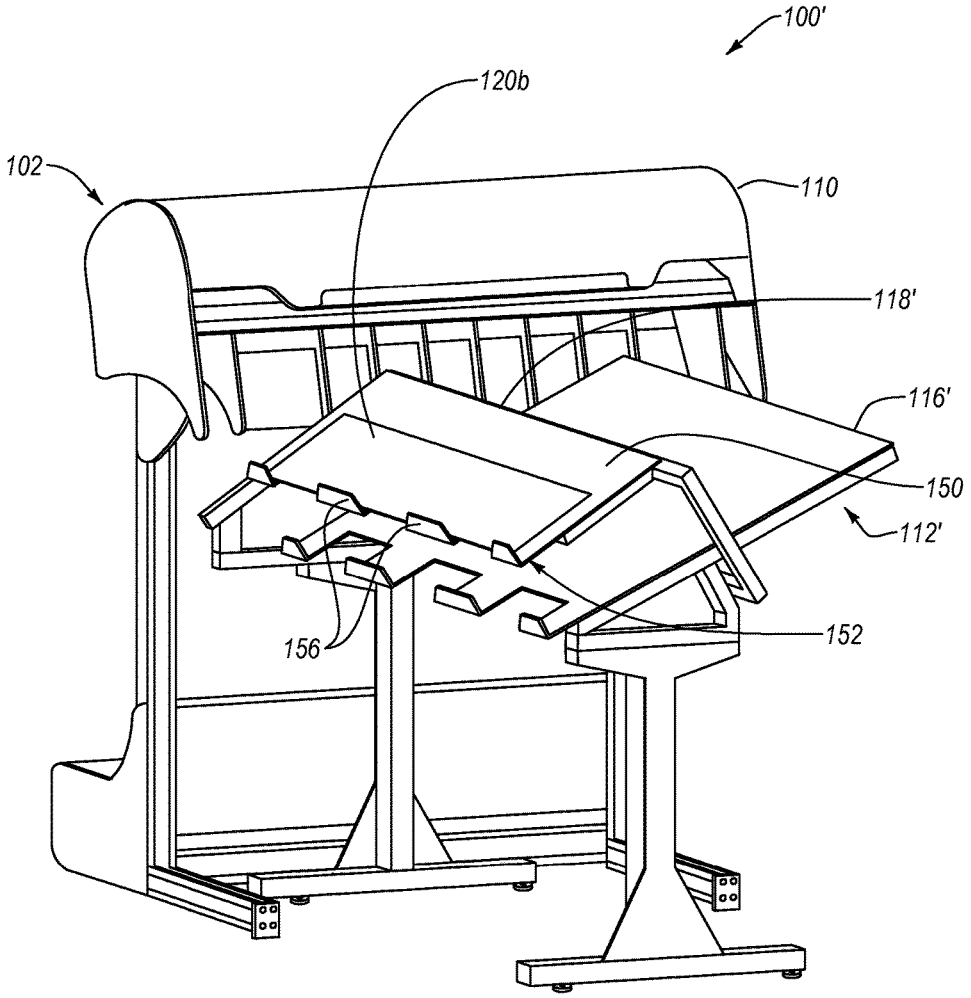
FIG. 12 illustrates an end perspective view of the system of FIG. 8 showing a packaging template moving from a second outfeed guide toward a first side of an outfeed table on a second retrieval guide.

FIGS. 9-12 illustrate examples of the system 100', and particularly the outfeed table 112', in use. More specifically, FIGS. 9 and 10 illustrate a packaging template 120*a* being guided out of the converting machine 102 by the first outfeed guide 116' and to the retrieval side 124' of the first retrieval guide 122'. Similarly, FIGS. 11 and 12 illustrate a packaging template 120*b* being guided out of the converting machine 102 by the second outfeed guide 118' and to the retrieval side 152 of the second retrieval guide 150.

FIG. 9 illustrates a packaging template 120*a* being guided out of the converting machine 102 by the first outfeed guide 116'. More specifically, a portion of the packaging template 120*a* rests on and slides over the first outfeed guide 116' as the packaging template 120*a* exits the converting machine 102. In the illustrated embodiment, the first outfeed guide 116' extends in a generally horizontal direction such that the packaging template 120*a* is maintained in a generally horizontal orientation as the packaging template 120*a* exits the converting machine 102.

As can be seen in FIG. 9, the center of gravity CG (illustrated with a dashed line) of the packaging template 120*a* is not positioned directly above or supported from underneath by the first outfeed guide 116'. As a result, once the converting machine 102 completes and releases the packaging template 120*a*, the gravitational force acting on the packaging template 120*a* will cause the packaging template 120*a* to rotate and descend onto the first retrieval guide 122', as illustrated in FIG. 10. The packaging template 120*a* will then slide down the first retrieval guide 122' toward the first side 124' thereof, as shown in dashed lines in FIG. 10. As noted above in connection with FIG. 8, the one or more stops 128' may prevent the packaging template 120*a* from sliding off of the first side 124' and/or hold the packaging template 120*a* on the first retrieval guide 122' until a user retrieves/removes the packaging template 120*a* therefrom.

FIG. 11 illustrates a packaging template 120*b* being guided out of the converting machine 102 by the second outfeed guide 118'. More specifically, a portion of the packaging template 120*b* rests on and slides over the second outfeed guide 118' as the packaging template 120*b* exits the converting machine 102. In the illustrated embodiment, the second outfeed guide 118' extends in a generally horizontal direction such that the packaging template 120*b* is maintained in a generally horizontal orientation as the packaging template 120*b* exits the converting machine 102.

As can be seen in FIG. 11, the center of gravity CG (illustrated with a dashed line) of the packaging template 120*b* is not positioned directly above or supported from underneath by the second outfeed guide 118'. As a result, once the converting machine 102 completes and releases the packaging template 120*b*, the gravitational force acting on the packaging template 120*b* will cause the packaging template 120*b* to rotate and descend onto the second retrieval guide 150, as illustrated in FIG. 12. The packaging template 120*b* will then slide down the retrieval guide 150 toward the first side 152 thereof. The one or more stops 156 associated with the second retrieval guide 150 may prevent the packaging template 120*b* from sliding off of the first side 152 and/or hold the packaging template 120*b* on the second retrieval guide 150 until a user retrieves/removes the packaging template 120*b* therefrom.

As noted above, the first sides 124', 152 of the first and second retrieval guides 122', 150 are generally horizontally aligned with one another and the first side 152 is positioned vertically above the first side 124'. As a result, as packaging templates 120 are produced by the converting machine 102, the outfeed table 112' guides the packaging templates 120 out of the converting machine 102 and towards the user side of the converting table 112'. Thus, a user may stand in one location (e.g., near the first sides 124', 152) and readily retrieve packaging templates 120 regardless of whether the packaging templates 120 are guided out of the converting machine 102 by the first or second outfeed guides 116', 118'. In other words, the outfeed table 112' directs the packaging templates 120 toward one side thereof so that the packaging templates 120 can be retrieved without requiring a user to reach over or walk around the outfeed table 112' to retrieve packaging templates 120 that are fed out of the converting machine 102 near a far side of the outfeed table 112'.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A system for forming packaging templates, the system comprising:

a converting machine that converts raw material into packaging templates for assembly into boxes or other packaging; and an outfeed table, comprising:

a frame;

an outfeed guide connected to the frame, the outfeed guide being aligned with the converting machine to guide a packaging template out of the converting machine in a first direction, the packaging template being formed from raw material from a supply of raw material, the outfeed guide having a longitudinal axis that extends generally parallel to the first direction, the outfeed guide being aligned with the converting machine such that the outfeed guide supports the packaging template from underneath as the packaging template is fed out of the converting machine in the first direction, the outfeed guide being horizontally offset from a center of gravity of the packaging template such that the outfeed guide is not positioned under the center of gravity of the packaging template, the outfeed guide being pivotally connected to the frame via a pivot frame that pivots relative to the frame in order to adjust the horizontal or vertical position of the outfeed guide;

a retrieval guide connected to the frame, the retrieval guide having a first side and a second side, the second side being positioned adjacent to the outfeed guide and the first side being positioned away from the outfeed guide, the retrieval guide comprising an angled surface such that the first side is vertically lower than the second side to enable a packaging template to slide across the angled surface in a second direction towards the first side, where the packaging template can be retrieved;

one or more stops disposed along the first side of the retrieval guide, the one or more stops being configured to prevent a packaging template from sliding off of the retrieval guide; and a limit mechanism that restricts a degree to which the pivot frame may pivot, thereby limiting the adjustment of the horizontal or vertical position of the outfeed guide.

2. The system of claim 1, wherein the outfeed guide comprises a generally planar surface.

3. The system of claim 1, wherein at least one of the outfeed guide and the retrieval guide is rotatably connected to the frame such that the at least one of the outfeed guide and the retrieval guide can be rotated relative to the frame to provide access to an area underneath the at least one of the outfeed guide and the retrieval guide.

4. The system of claim 1, further comprising a second outfeed guide connected to the frame, the second outfeed guide being configured to guide a second packaging template out of the converting machine, the second packaging template being formed from raw material from a second supply of raw material.

5. The system of claim 4, wherein the second outfeed guide is aligned with the converting machine to guide the second packaging template out of the converting machine in the first direction, the second outfeed guide being aligned with the converting machine such that the second outfeed guide is configured to support the second packaging template from underneath as the second packaging template is fed out of the converting machine in the first direction, the second outfeed guide being horizontally offset from a center a gravity of the second packaging template such that the second outfeed guide is not positioned under the center of gravity of the second packaging template.

6. The system of claim 4, wherein the second outfeed guide is positioned vertically above the retrieval guide.

7. The system of claim 4, wherein the second outfeed guide is horizontally offset from the outfeed guide.

8. The system of claim 4, wherein the second outfeed guide is adjustably connected to the frame such that a horizontal or vertical position of the second outfeed guide is selectively adjustable.

9. The system of claim 4, further comprising a second retrieval guide, the second retrieval guide being associated with the second outfeed guide.

10. The system of claim 9, wherein the second retrieval guide has a first side and a second side, the second side being positioned adjacent to the second outfeed guide and the first side being positioned away from the second outfeed guide, the second retrieval guide comprising an angled surface such that the first side is vertically lower than the second side to enable a packaging template to slide across the angled surface in the second direction towards the first side, where the packaging template can be retrieved.

11. An outfeed table for use in connection with a converting machine that converts fanfold material into packaging templates for assembly into boxes or other packaging, the outfeed table comprising:

a frame;

a first outfeed guide connected to the frame, the first outfeed guide being configured to guide a first packaging template out of a converting machine, the packaging template being formed from fanfold material from a first fanfold bale, the first outfeed guide being configured to be horizontally offset from a center a gravity of the first packaging template such that the first outfeed guide is not positioned under the center of gravity of the first packaging template;

a second outfeed guide connected to the frame, the second outfeed guide being configured to guide a second packaging template out of a converting machine, the second packaging template being formed from fanfold material from a second fanfold bale, the second outfeed guide being configured to be horizontally offset from a center a gravity of the second packaging template such that the second outfeed guide is not positioned under the center of gravity of the second packaging template, the second outfeed guide being horizontally offset from the first outfeed guide; and a retrieval guide connected to the frame, the retrieval guide having a first side and a second side, the second side being positioned adjacent to the first outfeed guide and the first side being positioned away from the first outfeed guide, the retrieval guide comprising an angled surface such that the first side is vertically lower than the second side to enable the first packaging template to slide across the angled surface towards the first side, where the first packaging template can be retrieved.

12. The outfeed table of claim 11, wherein the second outfeed guide is positioned vertically above the retrieval guide.

13. The outfeed table of claim 11, wherein the second outfeed guide is configured to allow the second packaging template to descend onto the retrieval guide.

14. The outfeed table of claim 11, wherein the first outfeed guide comprises a generally planar surface.

15. An outfeed table for use in connection with a converting machine that converts raw material into packaging templates for assembly into boxes or other packaging, the outfeed table comprising:

a frame;

a first outfeed guide connected to the frame, the first outfeed guide being configured to guide a first packaging template out of a converting machine, the packaging template being formed from raw material from a first supply of raw material, the first outfeed guide being configured to be horizontally offset from a center a gravity of the first packaging template such that the first outfeed guide is not positioned under the center of gravity of the first packaging template;

a second outfeed guide comprising an elongated tubular member connected to the frame, the second outfeed guide being configured to guide a second packaging template out of a converting machine, the second packaging template being formed from raw material from a second supply of raw material, the second outfeed guide being configured to be horizontally offset from a center a gravity of the second packaging template such that the second outfeed guide is not positioned under the center of gravity of the second packaging template, the second outfeed guide being horizontally offset from the first outfeed guide; and a retrieval guide connected to the frame, the retrieval guide having a first side and a second side, the second side being positioned adjacent to the first outfeed guide and the first side being positioned away from the first outfeed guide, the retrieval guide comprising an angled surface such that the first side is vertically lower than the second side to enable the first packaging template to slide across the angled surface towards the first side, where the first packaging template can be retrieved.

16. The outfeed table of claim 11, further comprising one or more stops disposed along the first side of the retrieval guide, the one or more stops being configured to prevent a packaging template from sliding off of the retrieval guide.

17. The outfeed table of claim 11, wherein a horizontal position of each of the first outfeed guide and the second outfeed guide is selectively and independently adjustable.

18. The outfeed table of claim 11, further comprising a second retrieval guide connected to the frame, the second retrieval guide having a first side and a second side, the second side being positioned adjacent to the second outfeed guide and the first side being positioned away from the second outfeed guide.

19. The outfeed table of claim 18, wherein the second retrieval guide comprises an angled surface such that the first side of the second retrieval guide is vertically lower than the second side of the second retrieval guide to enable the second packaging template to slide across the angled surface of the second retrieval guide towards the first side of the second retrieval guide, where the second packaging template can be retrieved.

20. The outfeed table of claim 19, wherein the second retrieval guide is vertically offset from the retrieval guide.

21. An outfeed table for use in connection with a converting machine that converts fanfold material into packaging templates for assembly into boxes or other packaging, the outfeed table comprising:

a first outfeed guide configured to guide a first packaging template out of a converting machine, the packaging template being formed from fanfold material from a first fanfold bale, the first outfeed guide being configured to be horizontally offset from a center a gravity of the first packaging template such that the first outfeed guide is not positioned under the center of gravity of the first packaging template;

a second outfeed guide configured to guide a second packaging template out of a converting machine, the second packaging template being formed from fanfold material from a second fanfold bale, the second outfeed guide being configured to be horizontally offset from a center a gravity of the second packaging template such that the second outfeed guide is not positioned under the center of gravity of the second packaging template, the second outfeed guide being horizontally offset from the first outfeed guide;

a first retrieval guide associated with the first outfeed guide, the first retrieval guide having a first side and a second side, the second side being positioned adjacent to the first outfeed guide and the first side being positioned away from the first outfeed guide, the first retrieval guide comprising an angled surface such that the first side is vertically lower than the second side to enable the first packaging template to slide across the angled surface towards the first side, where the first packaging template can be retrieved; and a second retrieval guide associated with the second outfeed guide, the second retrieval guide having a first side and a second side, the second side being positioned adjacent to the second outfeed guide and the first side being positioned away from the second outfeed guide, the second retrieval guide comprising an angled surface such that the first side is vertically lower than the second side to enable the second packaging template to slide across the angled surface towards the first side, where the second packaging template can be retrieved.

22. The outfeed table of claim 21, wherein the first side of the first retrieval guide is generally horizontally aligned with the first side of the second retrieval guide.

23. The outfeed table of claim 21, wherein the first side of the second retrieval guide is positioned generally vertically above the first side of the first retrieval guide.

* * * * *